US006425149B1

(12) United States Patent
Wang

(10) Patent No.: US 6,425,149 B1
(45) Date of Patent: Jul. 30, 2002

(54) CONNECTION DEVICE FOR CONNECTING AN EXTENSION TUBE TO A FAUCET

(76) Inventor: Te-Hsing Wang, No. 14, Lane 349, Min-Chuan Rd., Taichung City (TW)

( * ) Notice: Subject to any disclaimer, the term of this patent is extended or adjusted under 35 U.S.C. 154(b) by 0 days.

(21) Appl. No.: 09/629,137

(22) Filed: Jul. 31, 2000

(51) Int. Cl.[7] ..... E03C 1/04

(52) U.S. Cl. ..... 4/675; 285/8; 285/181; 285/184

(58) Field of Search ..... 4/675–678, 615; 239/600; 285/147.2, 147.3, 181, 184, 231, 319, 8

(56) References Cited

U.S. PATENT DOCUMENTS 2,529,685 A * 11/1950 Ginter ..... 285/184
2,815,973 A * 12/1957 Jackson ..... 285/184
3,064,998 A * 11/1962 Syverson ..... 285/184
3,638,968 A * 2/1972 Barks ..... 285/328
4,605,200 A * 8/1986 Huppee ..... 137/523
4,941,459 A * 7/1990 Mathur ..... 128/66
5,833,849 A * 11/1998 Primdahl ..... 285/8

* cited by examiner

*Primary Examiner*—Gregory L. Huson
*Assistant Examiner*—Tuan Nguyen

(57) ABSTRACT

A connection device for connecting an extension tube to a faucet includes a first member connected to a faucet, a second member which is connected to the extension tube, and a connection member rotatably connected to the first member and fixedly connected to the second member. A positioning member is biased by a spring and received in an engaging recess in the second member. The first member has a plurality of notches so that the positioning member is engaged with one of the notches when rotating the extension tube relative to the first member, and the user feels a click to index the positioning feature.

2 Claims, 10 Drawing Sheets

CONNECTION DEVICE FOR CONNECTING AN EXTENSION TUBE TO A FAUCET

FIELD OF THE INVENTION

The present invention relates to a connection device for connecting an extension tube to a faucet and the device has an index feature to position the extension tube at a desired position.

BACKGROUND OF THE INVENTION

A conventional extension tube 11 connected to a faucet 10 is shown in FIG. 1 and generally includes a connection means 14 which is connected between the an faucet 10 and the extension tube 11 so that the water flows from an opening 12 of the extension tube 11 when operating the faucet 10. The connection means 14 allows the extension tube 11 to be rotated about the faucet 10 so that the water reaches different position of the sink 13. However, the connection means 14 is designed to be connected only between the faucet 10 and the extension tube 11 so that the extension tube 11 can only rotate along a curve path as illustrated in FIG. 1. There are many areas in the sink 13 that the extension tube 11 cannot reach. This is not satisfied by the users who want the extension tube 11 can be moved to anywhere in the sink 13.

The present invention intends to provide a connection device for connection of extension tubes of a faucet. The connection device allows the extension tubes to be connected one by one and has an index feature which positions the extension tubes at desired positions.

SUMMARY OF THE INVENTION

In accordance with one aspect of the present invention, there is provided a connection device for connecting an extension tube and a faucet. The connection device comprises a tubular first member connected to the faucet and a flange extends radially inward from an inner periphery of the tubular first member with a central hole defined through the flange. A plurality of notches are defined in the inner periphery of the first member. A second member connected to the extension tube has a connection portion extending from a first end thereof and a recess is defined in a second end of the member. A passage is defined through the connection portion and communicates with the recess. The connection portion is rotatably engaged with the central hole. An engaging recess is defined in an outer periphery of the second member and a positioning member is movably engaged with the engaging recess. The positioning member is removably engaged with one of the notches.

The object of the present invention is to provide a connection device which connects an extension tube and a faucet, and there is a click sound to notify the user that the extension tube is position when pivoting the extension tube.

These and further objects, features and advantages of the present invention will become more obvious from the following description when taken in connection with the accompanying drawings which show, for purposes of illustration only, several embodiments in accordance with the present invention.

BRIEF DESCRIPTION OF THE, DRAWINGS

DETAILED DESCRIPTION OF THE PREFERRED EMBODIMENT

Figure 1:
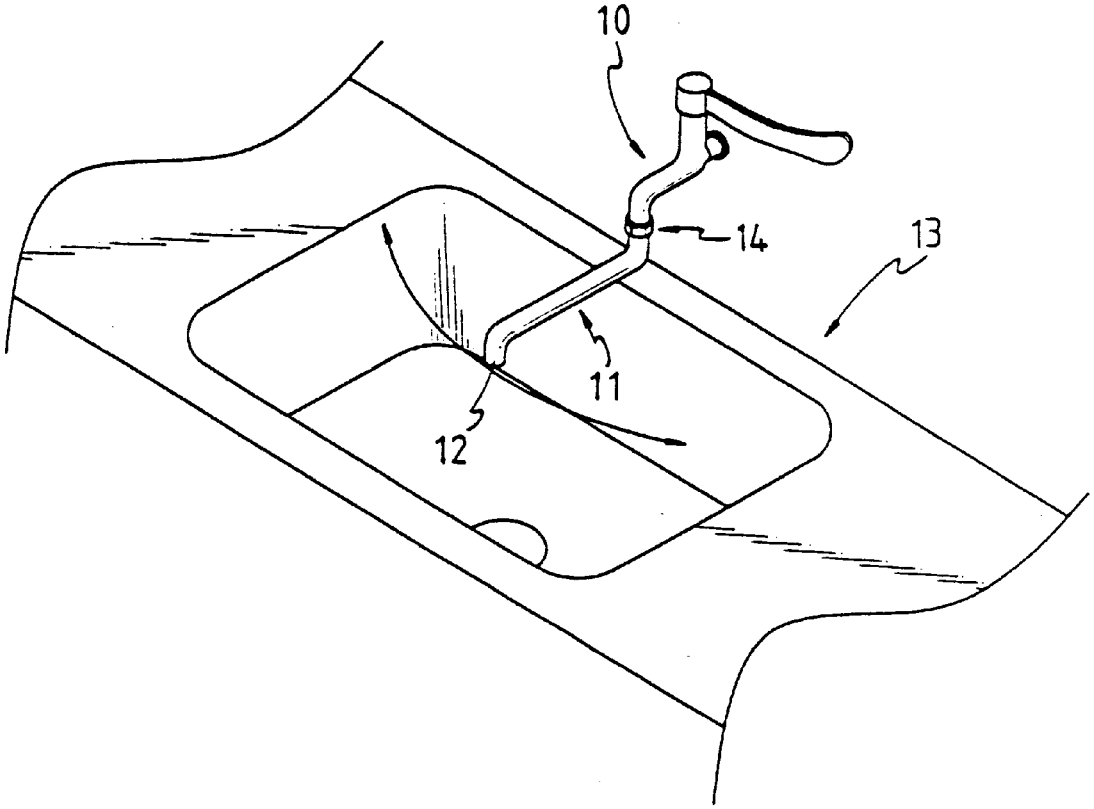
FIG. 1 is a perspective view to show a conventional connection device for connecting an extension tube and a faucet.
Figure 2:
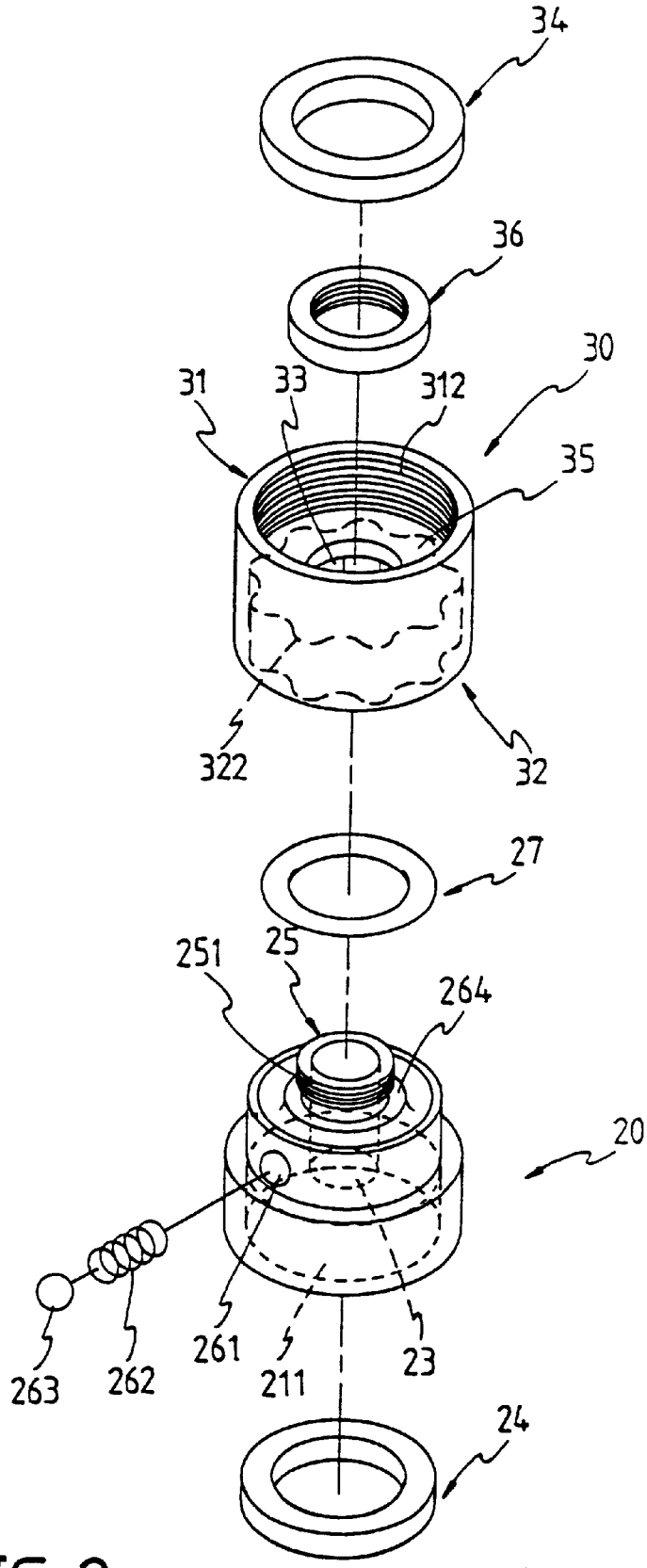
FIG. 2 is an exploded view to show a connection device for connecting an extension tube and a faucet of the present invention.
Figure 3:
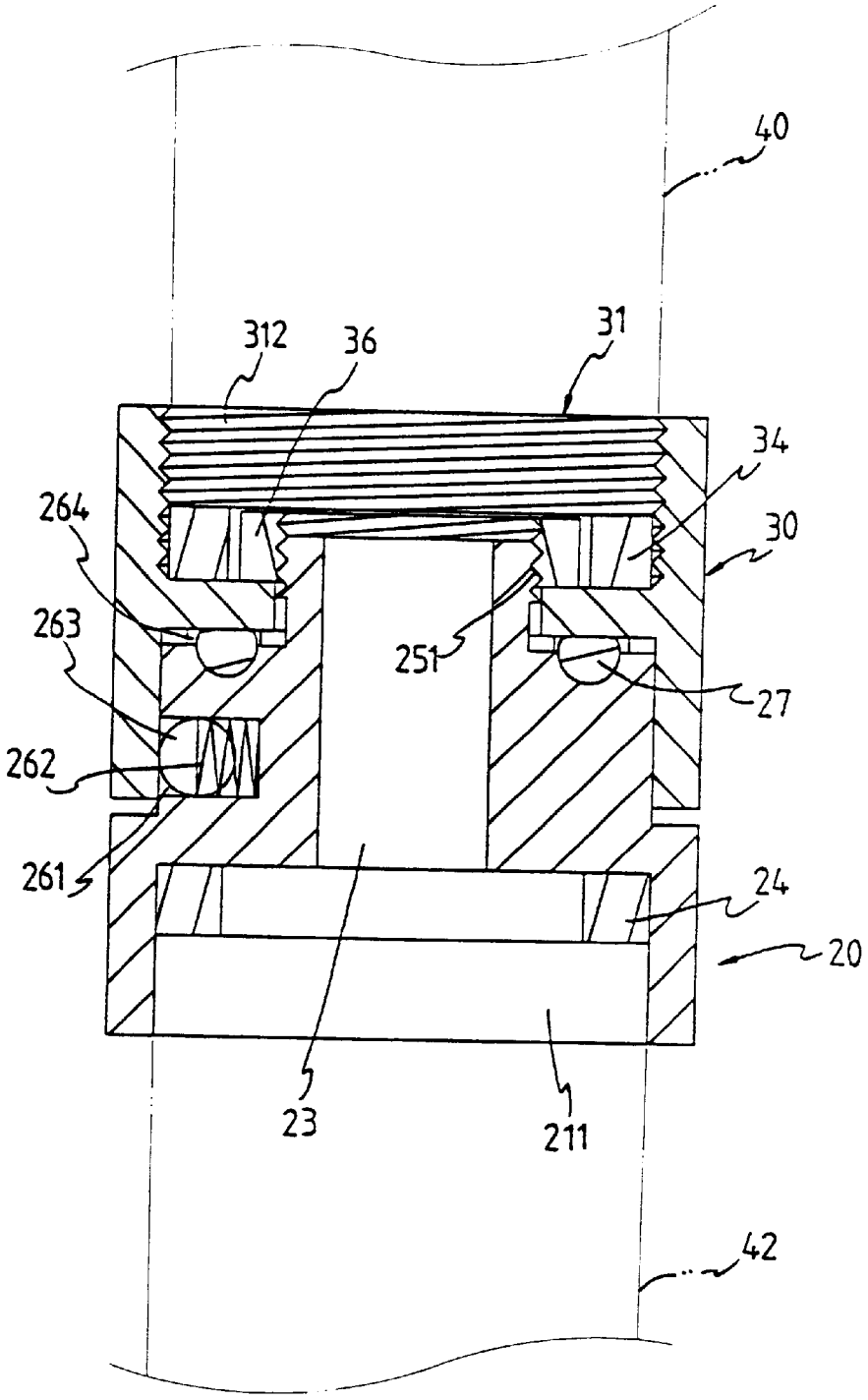
FIG. 3 is a cross sectional view to show the connection device of the present invention.
Figure 4:
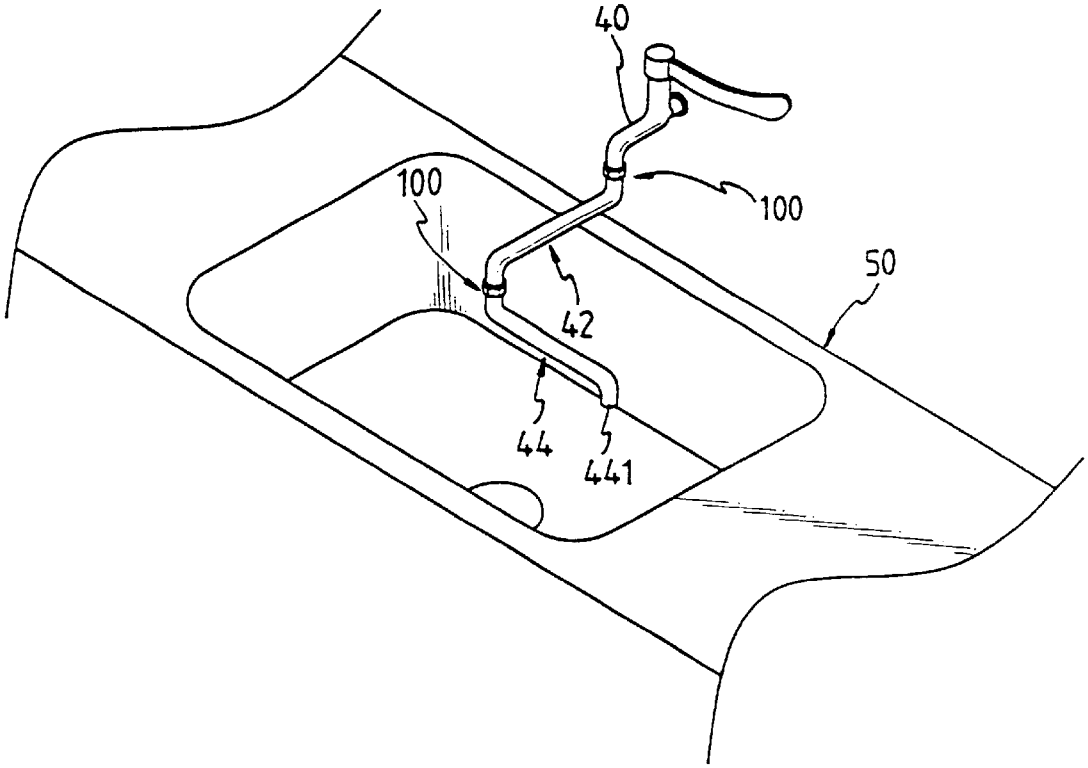
FIG. 4 is a perspective view to show two extension tubes and a facet are connected with other by the connection device of the present invention.

Referring to FIGS. 2 to 4, the connection device 100 in accordance with the present invention comprises a tubular first member 30 which has a flange 35 extending radially inward from an inner periphery of the tubular first member 30 and a central hole 33 is defined through the flange 35. The flange 35 separates the first member 30 into a first partition 31 and a second partition 32. A threaded portion 312 is defined in the inner periphery of the first partition of the first member 30 and a plurality of notches 322 defined in the second partition of the inner periphery of the first member 30. A seal 34 is put on the flange 35 and the threaded portion 312 is connected to a faucet 40.

A second member 20 has a connection portion 25 extending from a first end thereof and a recess 211 is defined in a second end of the member 20. A seal 24 is received in the recess 211 and an extension tube 42 is connected with the recess 211. A passage 23 is defined through the connection portion 25 and communicates with the recess 211. The connection portion 25 is rotatably engaged with the central hole 33 and has a threaded outer periphery 251. The connection portion 25 is inserted through the central hole 33 of the flange 35 and a collar 36 is threadedly engaged with the threaded outer periphery 251 of the connection portion 25. The collar 36 has an outer diameter which is larger than the central hole 33 so that the connection portion 25 will not disengaged from the central hole 33. An engaging recess 261 is defined in an outer periphery of the second member 20 and a spring 262 and a ball 263 are engaged with the engaging recess 261. The ball 263 is removably engaged with one of the notches 322. An annular groove 264 is defined in the second member 20 and encloses the connection portion 25. A seal 27 is engaged with the annular groove 264 and contacts against the flange 35.

As shown in FIG. 4, two connection devices 100, 100 are used to connect two extension tubes 42, 44 and the faucet 40 so that the open end of the extension tube 44 can be moved to desired position of a sink 50.

Figure 5:
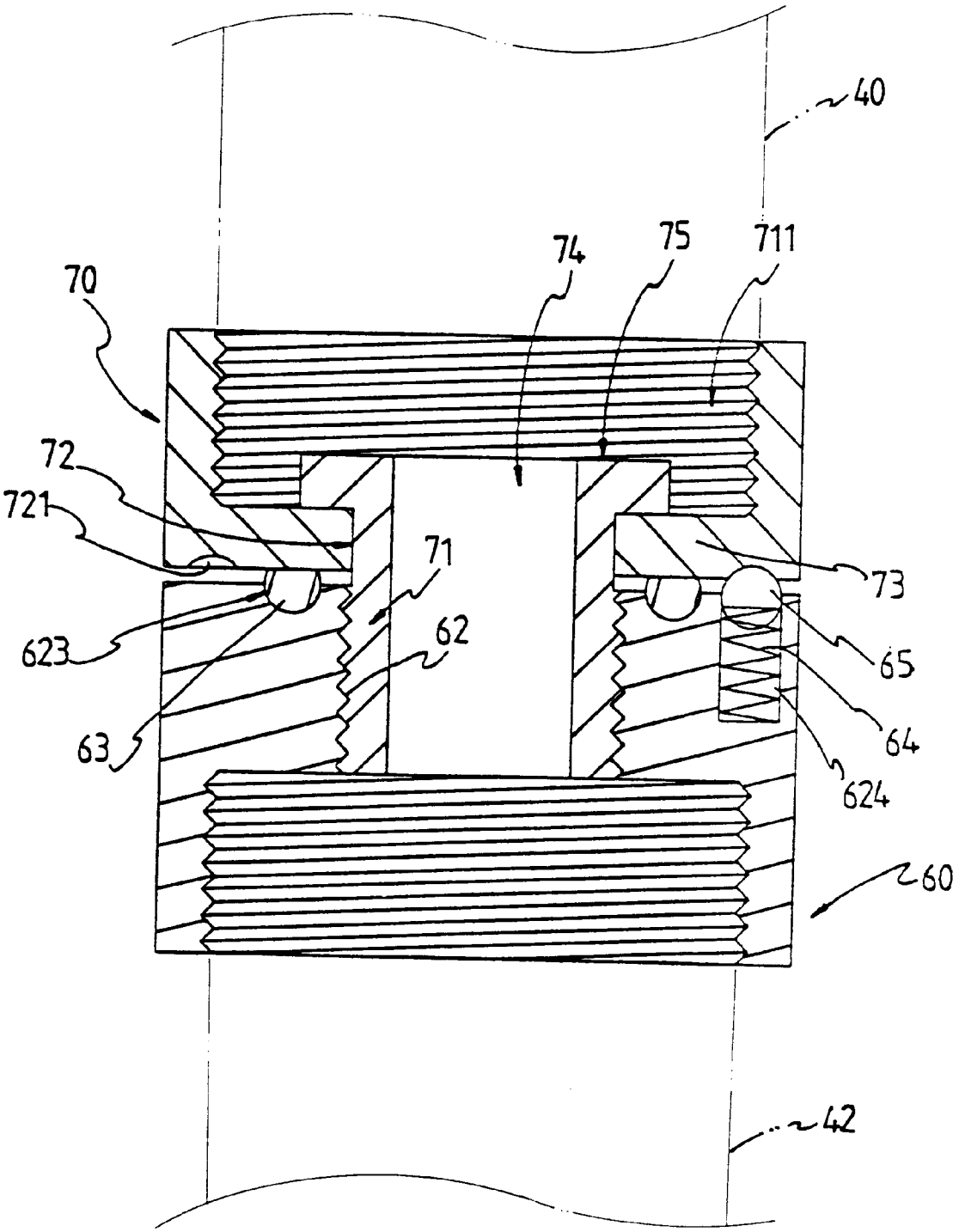
FIG. 5 is a cross sectional view to show another embodiment of the connection device of the present invention.

FIG. 5 shows another embodiment of the connection device and comprises a tubular first member 70 which is to be connected to the faucet 40 and a first flange 73 extends radially inward from an inner periphery of the tubular first member 70. A central hole 72 defined through the first flange 73. A threaded portion 711 is defined in the inner periphery of the first member 70 and a plurality of notches 721 are defined in an outer surface of the first flange 73. A connection member 71 is rotatably inserted through the central hole 72 and has a second flange 75 extending from an end thereof. The second flange 75 overlaps on the first flange 73 so that the connection member 71 will not drop from the central hole 72 of the first member 70. The connection member 71 has a threaded outer periphery.

A second member 60 connected to the extension tube 42 and a threaded passage 622 is defined through the second member 60. The threaded outer periphery of the connection member 71 is engaged with the threaded passage 622. An engaging recess 624 is defined in the second member 60 and a ball 65 biased by a spring 64 is movably engaged with the engaging recess 624. The ball 263 is removably engaged with one of the notches 721. An annular groove 623 is defined in the second member 20 and the passage 621 is enclosed by the annular groove 623. A seal 27 is engaged with the annular groove 623 and contacts against the first flange 73.

Figure 6:
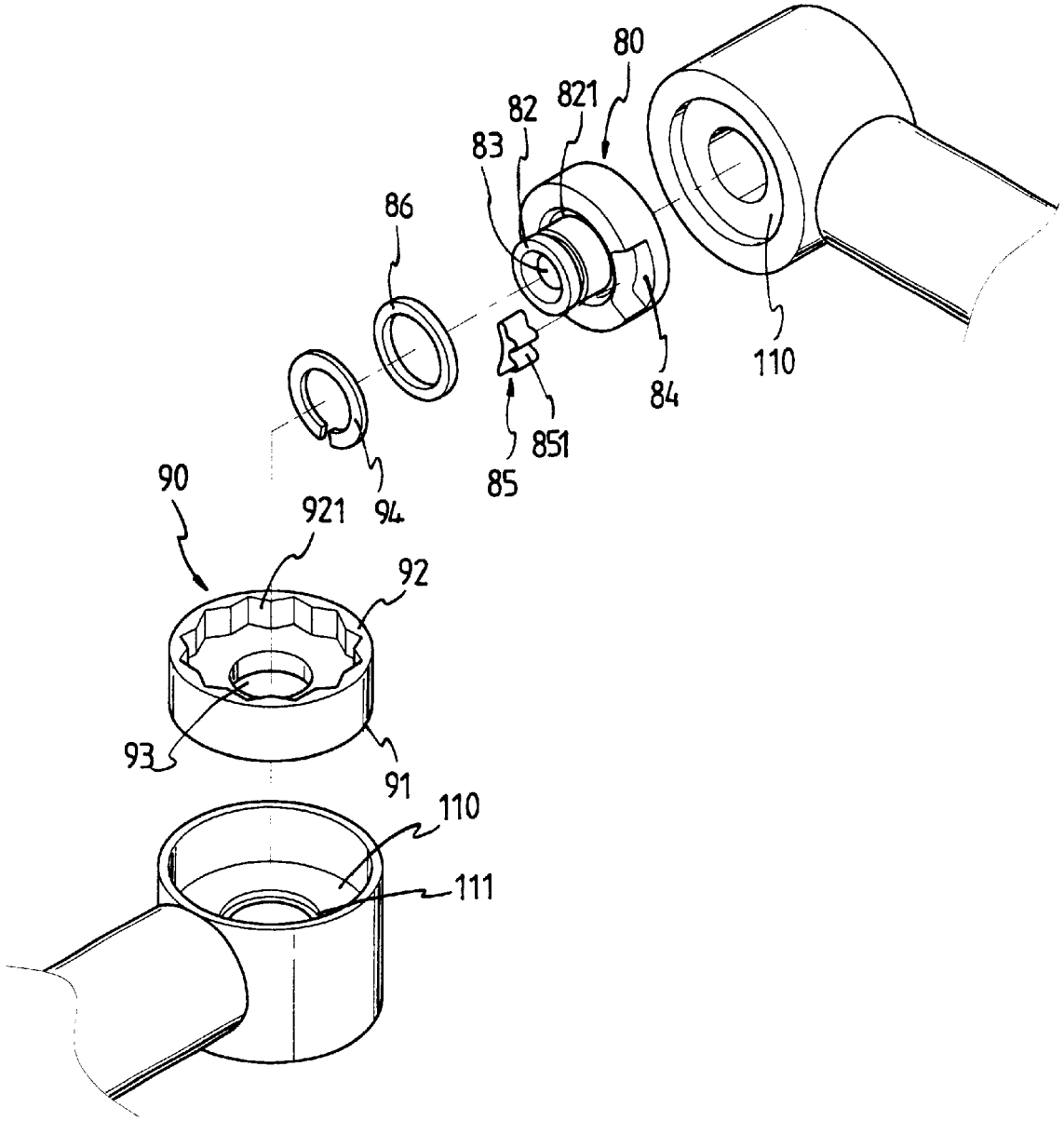
FIG. 6 is an exploded view to show yet another embodiment of the connection device for connecting two tubes.
Figure 7:
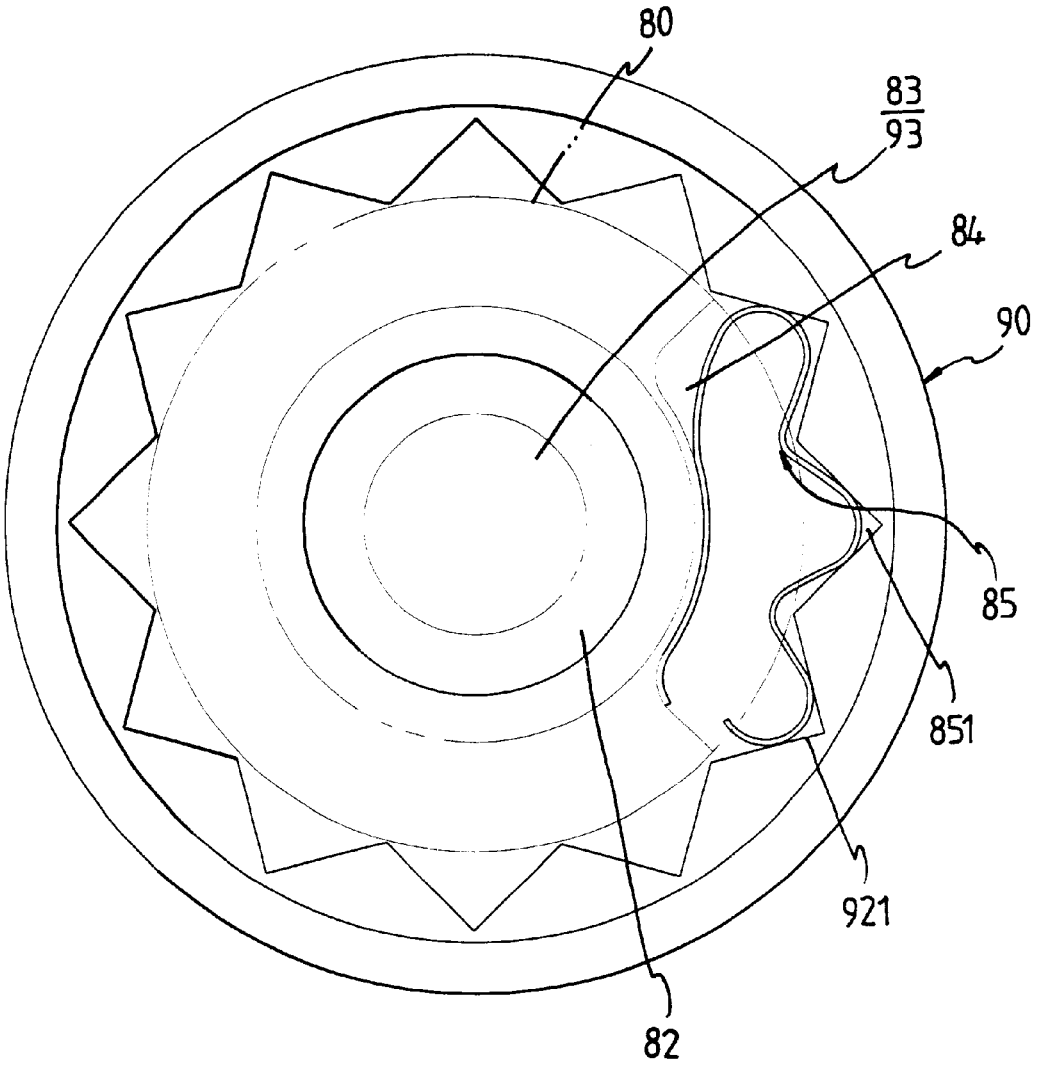
FIG. 7 is a plan view to show a positioning member is engaged with one of the notches in the first member of the connection device of the present invention.
Figure 9:
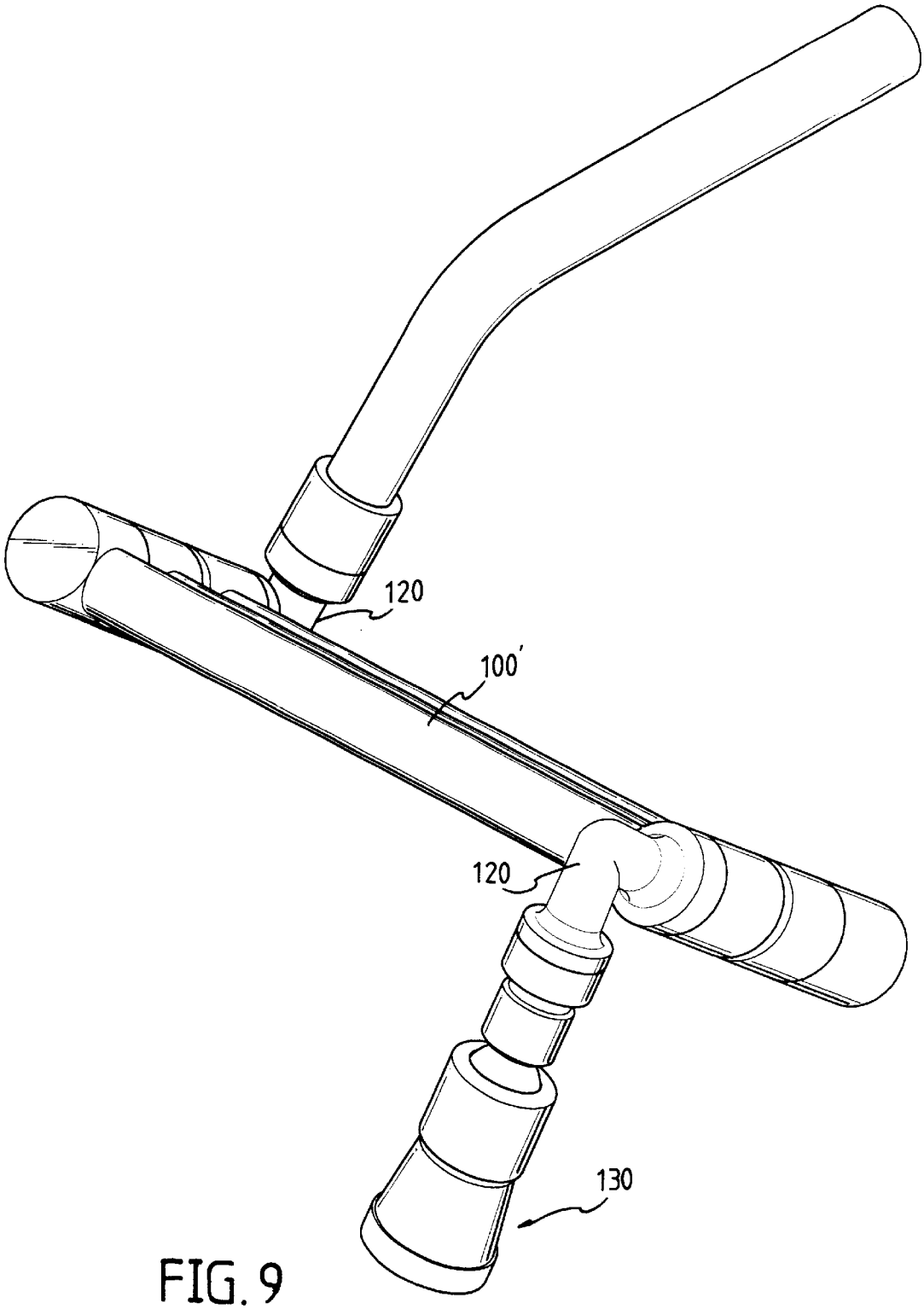
FIG. 9 is a perspective view to show the connection device can be used to connect tubes oriented toward different directions.

FIGS. 6 and 7 show yet another embodiment of the connection device of the present invention which is also used to cooperated with pipes of shower head 130 (FIG. 9). Each pipe has a head portion which has a recessed area 110 and an outlet 111 is defined through a bottom of the recessed area 110. A first member 90 is received in one of the recessed area 110 and has a central hole 93 defined therethrough. A plurality of notches 921 are defined in an inner periphery of a skirt portion of the first member 90. A second member 80 is received in the other recessed area 110 and has a connection portion 82 which is inserted through the central hole 111 and positioned by a C-shaped clamp 94. A central passage 83 is defined through the connection portion 82 and a seal 86 is received in a groove 821 enclosing the connection portion 82. An engaging recess 84 is defined in an outer periphery of the second member 80 and a positioning member 85 is engaged with the engaging recess 84. The positioning member 85 has a resilient projection 851 which is engaged with 11 one of the notches 921.

Figure 8:
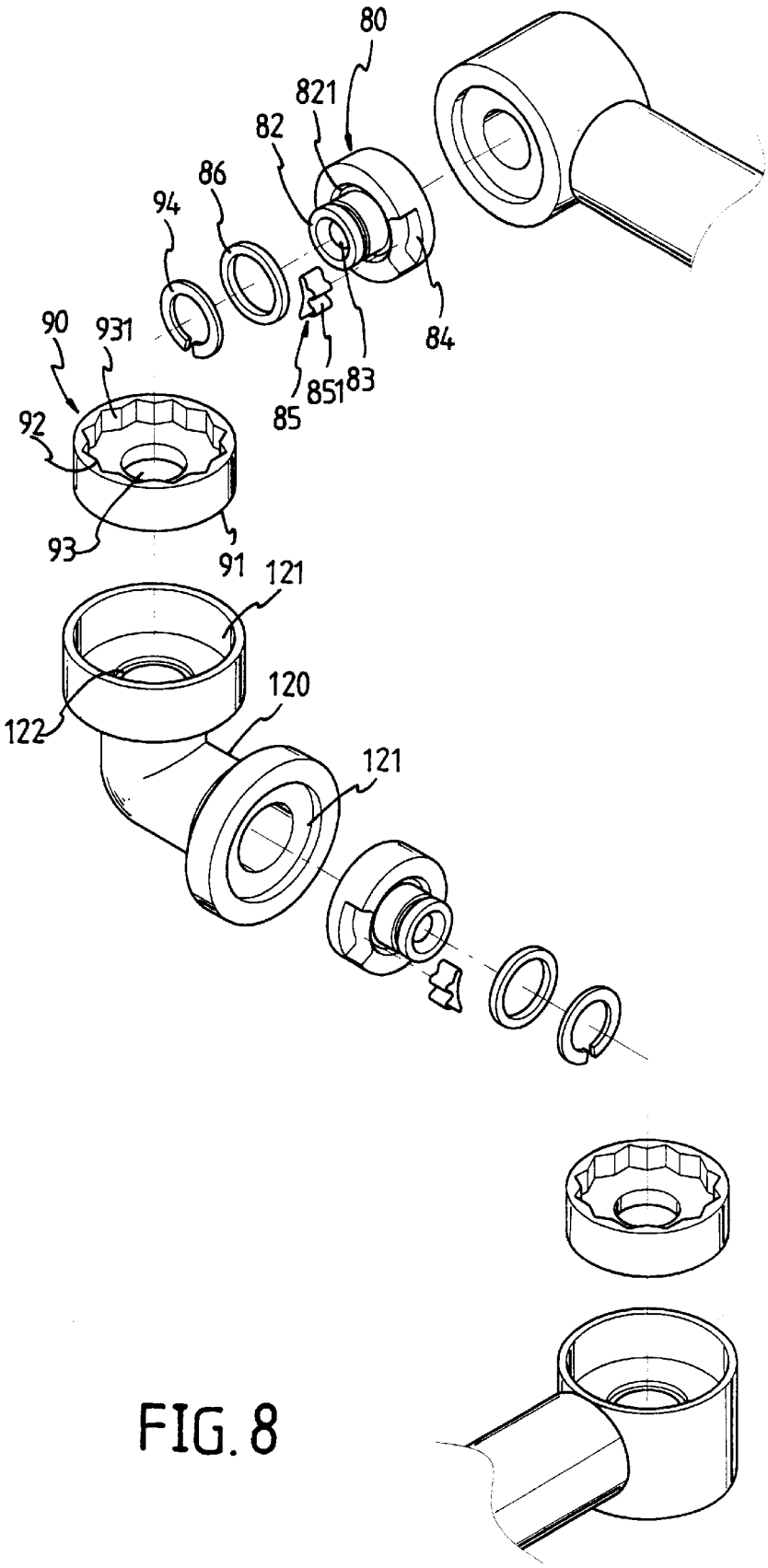
FIG. 8 is an exploded view to show two sets of the connection device of the present invention and an elbow for connecting two tubes.

FIG. 8 shows that two sets of the connection device of the present invention are connected to two ends of an elbow 120 to connect two pipes of different directions. Each end of the elbow 120 has a recessed area 121 and a passage 122 is defined through the elbow 120. Each connection device is connected between the head portion of the pipe and one of the recessed area 121 of the elbow 120 so that two pipes oriented at different directions can be connected by the elbow 120 and two sets of the connection device.

Figure 10:
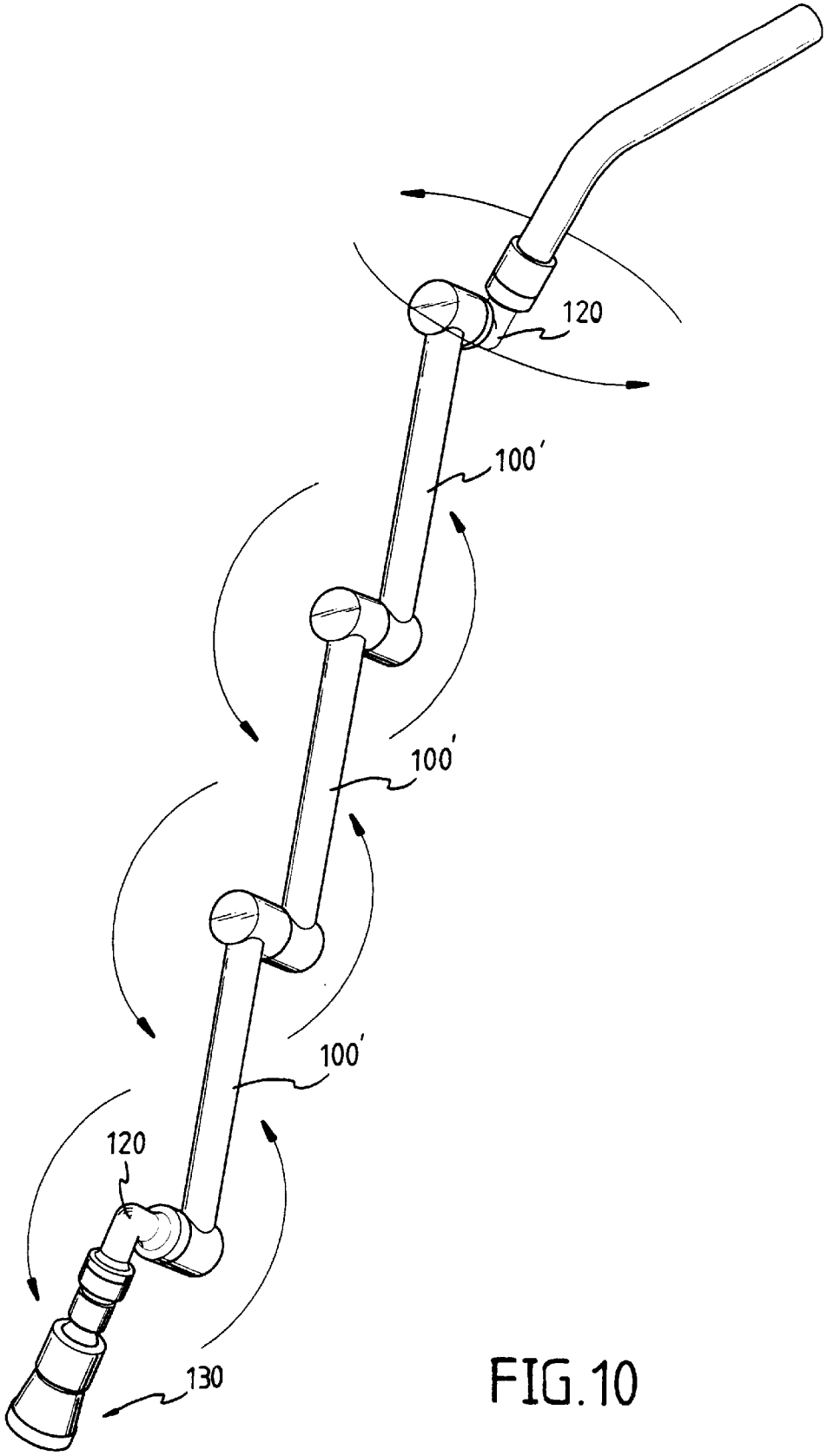
FIG. 10 is an illustrative view to show many sections of tube are connected by the connection device and connected to a shower head.

FIGS. 9 and 10 respectively illustrate many elbows 120 and many sets of connection device are used to connect many pipes 100', and a shower head 130 is connected to a distal end of the assembly. This is especially helpful for a fixed type shower head which is pivotally connected to a wall and cannot be removed from the wall.

While we have shown and described various embodiments in accordance with the present invention, it should be clear to those skilled in the art that further embodiments may be made without departing from the scope and spirit of the present invention.

What is claimed is:

1. A connection device for connecting an extension tube and a faucet, said device comprising:

a tubular first member adapted to be connected to the faucet and a flange extending radially inward from an inner periphery of said tubular first member, a central hole defined through said flange, a plurality of notches defined in said inner periphery of said first member, and a second member adapted to be connected to the extension tube and a connection portion extending from a first end thereof, a passage defined through said connection portion, said connection portion rotatably engaged with said central hole, an engaging recess defined in an outer periphery of said second member and a positioning member engaged with said engaging recess, said positioning member removably engaged with one of said notches.

2. The device as claimed in claim 1 further comprising an annular groove defined in said second member and enclosing said connection portion, a seal engaged with said annular groove and contacting against said flange.

* * * * *